US007011527B1

(12) United States Patent
Li

(10) Patent No.: US 7,011,527 B1
(45) Date of Patent: Mar. 14, 2006

(54) NEGATIVE GRAVITY THERAPEUTIC METHODS

(76) Inventor: Shu Li, 566 Nyes Pl., Laguna Beach, CA (US) 92651

( * ) Notice: Subject to any disclaimer, the term of this patent is extended or adjusted under 35 U.S.C. 154(b) by 352 days.

(21) Appl. No.: 10/330,610

(22) Filed: Dec. 27, 2002

(51) Int. Cl.
*A61J 5/00* (2006.01)

(52) U.S. Cl. ..... 434/262; 5/610; 606/244; 482/144

(58) Field of Classification Search ..... 434/262; 5/610; 606/244; 482/144
See application file for complete search history.

(56) References Cited

U.S. PATENT DOCUMENTS 3,081,085 A * 3/1963 De Girolamo ..... 482/144
3,310,289 A 3/1967 Burke
3,794,023 A * 2/1974 Bradley ..... 606/244
4,227,269 A 10/1980 Johnston
4,442,832 A * 4/1984 Ollenberger ..... 606/244
4,739,749 A * 4/1988 Lindley ..... 606/244
4,751,917 A * 6/1988 Ruf ..... 601/34
4,856,129 A 8/1989 Butler
5,416,939 A * 5/1995 Maalouli ..... 5/610
5,713,091 A 2/1998 Houchin
6,243,897 B1 * 6/2001 Sumiya ..... 5/610

* cited by examiner

*Primary Examiner*—Dmitry Suhol
(74) *Attorney, Agent, or Firm*—Parsons & Goltry; Michael W. Goltry; Robert A. Parsons

(57) ABSTRACT

A sleeping method for a participant having a foot end and a head end including 1)providing a sleeping surface having upper and lower ends, the sleeping surface inclined at least 10–25 degrees from the upper end to the lower end, 2)providing a predetermined unit of time having successive nightly sleep periods, and 3)the participant sleeping on the sleeping surface in a head down position for at least half or other portion of the successive nightly sleep periods, the head down position comprising the participant laying down on the sleeping surface with the legs and feet of the participant disposed toward the upper end of the sleeping surface and the head end of the participant disposed toward the lower end of the sleeping surface, in which the feet end of the participant is upward relative to the head end of the participant.

4 Claims, 1 Drawing Sheet

NEGATIVE GRAVITY THERAPEUTIC METHODS

FIELD OF THE INVENTION

This invention relates to therapeutic methods for causing beneficial biological results in humans such as better overall health and increased longevity/anti-aging and, more particularly, to negative gravity therapeutic methods.

BACKGROUND OF THE INVENTION

The force of gravity on humans forces down the internal organs of the body, such as the heart, liver, and stomach, and also bodily fluids, such as blood and lymph system fluids. Fortunately, the human body has a variety of supporting tissue and mechanisms, including ligament and muscle material, which hold organs in place, and strong hearts that pump blood upward to the brain and the upper extremities.

When people stand up, all vertical structures are affected by gravity. For instance, peoples' spines are pulled down and compressed. Because the force of gravity compresses bones at the discs and joints, people become shorter as they age. Because the organs, too, are pulled down as age increases, supporting tissue, such as supporting muscle and ligaments, become stretched and sag causing the lower abdomen to become enlarged, even without added fat.

Gravity also pulls body fat downward, which contributes to the development of eye bags and double chins. More fat is pulled to the belly, hips, and thighs. Gravity also makes the buttocks and breasts sag. Furthermore, the force of gravity also pulls down blood. As the heart weakens with age, a phenomenon that is well understood, its ability to counter gravity and pump blood up to the head and other small vessels in the upper parts of the body lessens. Gravity also increases metabolic rates, since the body has to counter gravitational force, which increases the speed of aging.

And so as people go through life, they are pulled constantly toward the earth by the natural force of gravity restricting blood flow to the head and causing skin to sag and internal organs and fat to sag downward as a result of the stretching and weakening of support tissue such as ligament and muscle tissue. In a straight head down position feet up position, in which a participant is disposed in a substantially vertical orientation with the feet positioned directly over the head, gravity acts on the body in the opposite direction, which is effectively a direct negative gravity environment, given that a head up position is considered a direct positive gravity environment. Although it is understood that direct negative gravity produces benefits to the internal organs and the vascular system of the human body, the human body cannot sustain a direct head down position for very long, perhaps 20 to 30 minutes, as it becomes very uncomfortable and will eventually cause the participant to faint or black out, due to high pressure to the head. The body is simply not evolved to handle this situation very long. Thus, all the head down exercises used today have such a short time span having little impact to offset the lifelong gravity downward pull.

Given the adverse impact of gravity on the human body, it would be highly desirable to provide new and improved therapeutic methods designed to counter the detrimental impact gravity levies on people during the normal course of life and for imparting meaningful and beneficial biological results to the organs and vascular system of humans.

SUMMARY OF THE INVENTION

The above problems and others are at least partially solved and the above purposes and others realized in improved therapeutic methods. In accordance with the principle of the invention, an exemplary method embodiment is a sleeping method for a participant having a foot end and a head end, which comprises providing an inclined, substantially flat/straight sleeping surface having upper and lower ends, and providing a nightly sleep period. In a particular embodiment, the method includes the participant sleeping on the sleeping surface in a head down position for at least a portion of the nightly sleep period. The head down position consists of the participant lying down on the sleeping surface with the leg end of the participant disposed upward relative to the head end of the participant. In accordance with the invention, this head down position disposes the legs and feet of the participant at an elevated location relative to the head, thus imparting a negative gravity state to the participant during the designated nightly sleep periods. Preferably, the inclined sleeping surface is inclined from 10–25 degrees. In accordance with the invention, the method can include the participant sleeping on the sleeping surface in the head down position for one nightly sleep period, two nightly sleep periods, three nightly sleep periods, etc.

In an exemplary embodiment, the method provides providing a predetermined unit of time having successive nightly sleep periods. In a particular embodiment, the method includes the participant sleeping on the sleeping surface in the head down position for at least half of the successive nightly sleep periods, or other predetermined number of the successive nightly sleep periods as may be desired. In a particular embodiment, the predetermined unit of time consists of at least a weekly unit of time. In another embodiment, the predetermined unit of time consists of at least a monthly unit of time. In yet another embodiment, the predetermined unit of time consists of at least a yearly unit of time.

It is to be understood that the sleeping surface is disposed at an angle of incline, which angle of incline is, according to a preferred embodiment, a 10–25 degree angle of incline. In another aspect, the invention provides adjusting the angle of incline between successive nightly sleep periods. This imparts different levels of negative gravity force to the participant, enhancing the application of the negative gravity therapy by preventing the participant from becoming accustom to one particular angle of incline, and allowing the participant to, for instance, get used to the head down sleep position through a gradual increase in the angle of incline.

BRIEF DESCRIPTION OF THE DRAWINGS

Referring to the drawings.

DETAILED DESCRIPTION OF A PREFERRED EMBODIMENT

Figure 1:
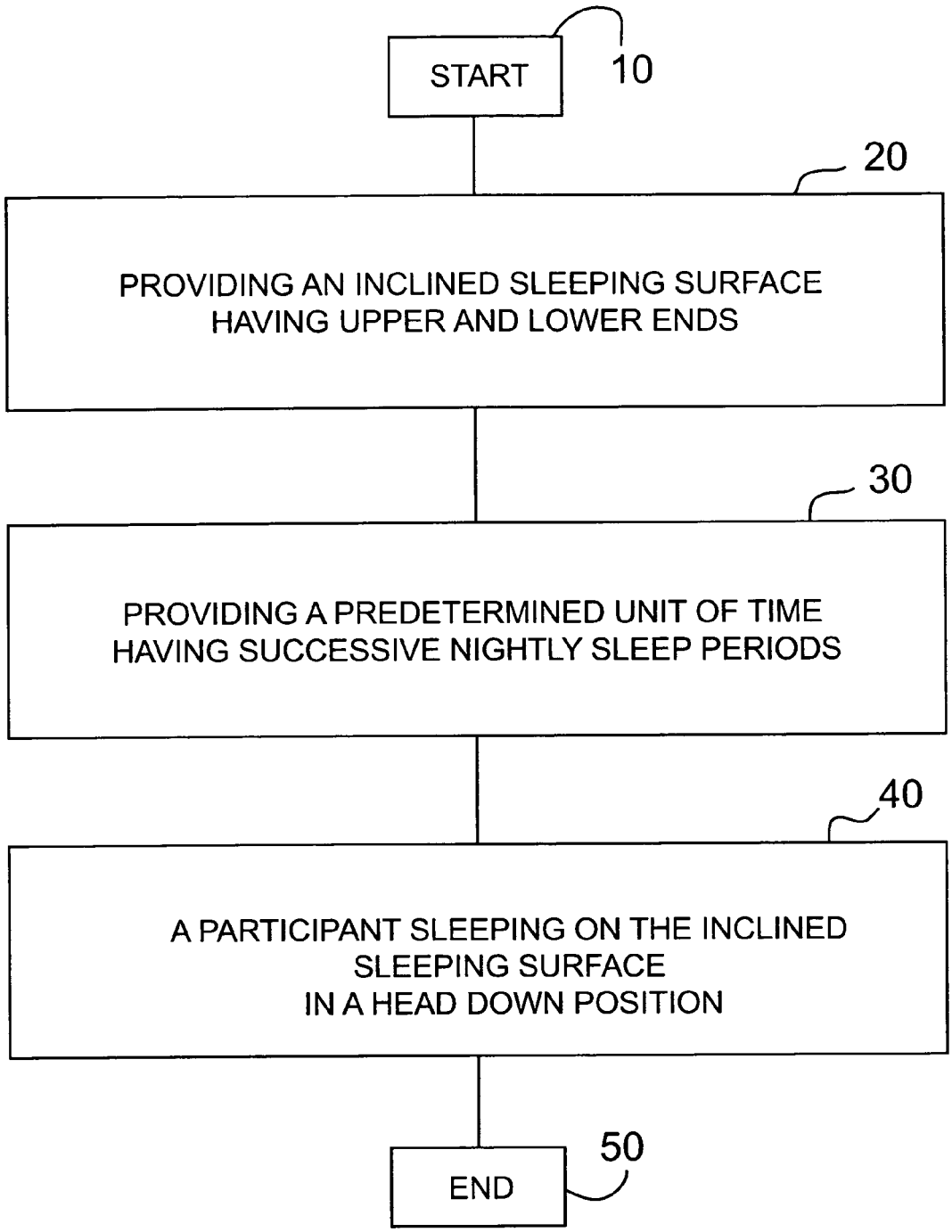
FIG. 1 is a flow chart illustrating a new and improved therapeutic method, in accordance with the principle of the invention.

Ensuing embodiments of the invention are concerned principally with persistent negative gravity therapy, which involves positioning a participant in a head down position during nightly sleeping periods for improving blood circulation through the veins of the body of the participant, improving lymph fluid circulation through the lymph system of the body of a participant, reversing the stress to ligament, muscle and other internal organ supporting tissue and mechanisms, releasing the compressing force to the joints and spine, etc. In accordance with the principle of the invention, an exemplary method embodiment is a sleeping method for a human participant having a foot end and a head end. The foot end of the participant is considered the lower extremity of the participant from the waist down including the legs and feet of the participant. The head end of the participant is considered the upper extremity of the participant from the waist up including the upper torso and the arms and head of the participant.

Turning to FIG. 1, in which like reference characters indicate corresponding elements throughout, the method starts 10 by providing 20 an inclined sleeping surface having upper and lower ends, and providing 30 a predetermined unit of time having successive nightly sleep periods. The inclined sleeping surface is flat/straight and, preferably, part of a bed consisting of, for instance, a piece of furniture for reclining and sleeping, typically consisting of a frame and a mattress resting on springs. The mattress defines the sleeping surface and its upper and lower ends. This bed arrangement is well known and generally representative of a typical bed, except for the foot end raised up providing the inclined sleeping surface, further details of which will not be further discussed. Other bed forms or arrangements can be used, if desired, which include the described sleeping surface.

In accordance with the principle of the invention, the inclined sleeping surface is inclined 10–25 degrees of horizontal, in which the upper end of the sleeping surface is elevated relative to the lower end of the sleeping surface. The degree of angle may be smaller than 10 degrees or larger than 25 degrees depending on the comfort level of the participant and professional advice. It is to be understood that the upper and lower ends of the sleeping surface are defined as such as a result of their orientation relative to one another, namely, the upper end being elevated relative to the lower end. The angle of incline of the sleeping surface can be set manually, such as with blocks or the like. The bed can also incorporate any of a variety of well-known mechanical lifting mechanisms, such as hydro-electrical lifting mechanisms, for facilitating the adjustment of the mattress for disposing the sleeping surface at the desired angle of incline.

Further to FIG. 1, the method further includes a participant sleeping 40 on the sleeping surface in a head down position for a predetermined number of the successive nightly sleep periods for introducing beneficial negative gravity therapy of an amount that is sufficient to impart biologically beneficial results to the body of the participant, namely, to improve blood circulation through the veins of the body of the participant, to improve lymph fluid circulation through the lymph system of the body of the participant, and to reversing the stress to ligament, muscle and other internal organ supporting tissue and mechanisms of the body of the participant, which ends 50 the method. The head down position consists of the participant lying down on the sleeping surface with the leg end of the participant disposed toward the upper end of the sleeping surface and the head end of the participant disposed toward the lower end of the sleeping surface. In this head down position, the leg end of the participant is disposed upward relative to the head end of the participant, causing the participant to experience a negative gravity force as governed by the incline of the inclined sleeping surface.

As previously described, the angle of incline of the sleeping surface is 10–25 degrees. This 10–25 degree angle of incline of the sleeping surface provides a desired negative gravity affect on a participant lying thereon in a head down position as described, but is not so steep as to cause discomfort or so shallow as to be incapable of exposing a participant lying thereon in the head down position to a sufficient amount of negative gravity. It is, therefore, to be understood that the 10–25 angle of incline of the sleeping surface is an optimum range of incline for the sleeping surface for exposing a participant lying thereon in the head down position to negative gravity or otherwise disposing the participant in a negative gravity state while not compromising comfort in sleeping.

In accordance with this disclosure, the term "nightly sleep period" consists of a period of sleep occurring at, proximate, or between the period between sunset and sunrise, especially the hours of darkness. The term "day" consists of a 24-hour unit during which Earth completes one rotation on its axis.

As previously set forth, the method of the invention includes the step of a participant sleeping 40 on the sleeping surface in a head down position for a predetermined number of the successive nightly sleep periods for introducing beneficial negative gravity therapy of an amount that is sufficient to impart biologically beneficial results. This can involve a participant sleeping surface in a head down position for a portion of a nightly sleep period such as half of a nightly sleep period, one nightly sleep period, two successive nightly sleep periods, three successive nightly sleep periods, four successive nightly sleep periods, ten successive nightly sleep periods, etc., in which beneficial negative gravity therapy of an amount that is sufficient to impart biologically beneficial results in the participant is achieved. A participant can sleep in the head down position for every nightly sleep period throughout his lifetime, if desired, for maintaining the benefits of the method of the invention. Exemplary embodiments follow, in which beneficial negative gravity therapy of an amount that is sufficient to impart biologically beneficial results in the participant is achieved.

In a particular embodiment, the predetermined unit of time consists of at least a weekly unit of time, namely, a unit of seven days. In this embodiment, the step of the participant sleeping 40 on the sleeping surface in the head down position for a predetermined number of the successive nightly sleep periods consists of the participant sleeping on the sleeping surface in the head down position for all of the successive nightly sleep periods for the weekly unit of time. A participant sleeping on the sleeping surface in the head down position for all of the successive nightly sleep periods for the weekly unit of time results in the application of beneficial negative gravity therapy to the body of the participant. In another aspect, the step of the participant sleeping 40 on the sleeping surface in the head down position for a predetermined number of the successive nightly sleep periods consists of the participant sleeping on the sleeping surface in the head down position for at least half of the successive nightly sleep periods for the weekly unit of time. A participant sleeping on the sleeping surface in the head down position for at least half of the successive nightly sleep periods for the weekly unit of time results in the application of beneficial negative gravity therapy to the body of the participant.

In a further embodiment of the invention, the predetermined unit of time consists of at least a monthly unit of time, namely, a unit of time corresponding approximately to one cycle of the moon's phases, or about 30 days of four weeks. In this embodiment, the step of the participant sleeping 40 on the sleeping surface in the head down position for a predetermined number of the successive nightly sleep periods consists of the participant sleeping on the sleeping surface in the head down position for all of the successive nightly sleep periods for the monthly unit of time. A participant sleeping on the sleeping surface in the head down position for all of the successive nightly sleep periods for the monthly unit of time results in the application of beneficial negative gravity therapy to the body of the participant. In another aspect, the step of the participant sleeping 40 on the sleeping surface in the head down position for a predetermined number of the successive nightly sleep periods consists of the participant sleeping on the sleeping surface in the head down position for at least half of the successive nightly sleep periods for the monthly unit of time. A participant sleeping on the sleeping surface in the head down position for at least half of the successive nightly sleep periods for the monthly unit of time results in the application of beneficial negative gravity therapy to the body of the participant.

In yet a further embodiment of the invention, the predetermined unit of time consists of at least a yearly unit of time, namely, a unit of time during which Earth completes a single revolution around the sun, consisting of approximately 365 days. In this embodiment, the step of the participant sleeping 40 on the sleeping surface in the head down position for a predetermined number of the successive nightly sleep periods consists of the participant sleeping on the sleeping surface in the head down position for all of the successive nightly sleep periods for the yearly unit of time. A participant sleeping on the sleeping surface in the head down position for all of the successive nightly sleep periods for the yearly unit of time results in the application of beneficial negative gravity therapy to the body of the participant. In another aspect, the step of the participant sleeping 40 on the sleeping surface in the head down position for a predetermined number of the successive nightly sleep periods consists of the participant sleeping on the sleeping surface in the head down position for at least half of the successive nightly sleep periods for the yearly unit of time. A participant sleeping on the sleeping surface in the head down position for at least half of the successive nightly sleep periods for the yearly unit of time results in the application of beneficial negative gravity therapy to the body of the participant.

It is to be understood that the sleeping surface is disposed at an angle of incline, which angle of incline is, according to a preferred embodiment, a 10–25 degree angle of incline. In another aspect, the invention provides adjusting the angle of incline between one or more of the successive nightly sleep periods in which the participant is sleeping in the head down position. This functions to impart different levels of negative gravity force to the participant, which enhances the application of the negative gravity therapy by preventing the participant from becoming accustom to one particular angle of incline, and allowing the participant to, for instance, get used to the head down sleep position through a gradual increase in the angle of incline.

The method set forth above and illustrated in FIG. 1, and its various embodiments, provide persistent beneficial negative gravity therapy to the body of a participant during periods of nightly sleep, improving blood circulation through the veins of the body of the participant, improving lymph fluid circulation through the lymph system of the body of a participant, reversing the stress to ligament and muscle and other internal organ supporting tissue and mechanisms, decreasing heart contractility and the work required of the heart to move blood throughout the body, and increasing blood plasma volume. A participant employing the method set forth in this disclosure may experience other beneficial results, including deeper and more restful sleep due to lower heart rate and lower metabolic rate, a lowering of blood pressure, increased hormonal responses, a better tolerance and response to negative gravity situations, etc.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A sleeping method for a participant having a foot end and a head end, the method comprising steps of:

a) providing a sleeping surface having upper and lower ends, the sleeping surface inclined at an angle of incline falling in an incline range of 10–25 degrees from the upper end to the lower end;

b) providing a predetermined unit of time having successive nightly sleep periods;

c) the participant sleeping on the sleeping surface in a head down position for at least half of the successive nightly sleep periods, the head down position comprising the participant laying down on the sleeping surface with the legs and feet of the participant disposed toward the upper end of the sleeping surface and the head end of the participant disposed toward the lower end of the sleeping surface, in which the feet end of the participant is upward relative to the head end of the participant; and d) adjusting the angle of incline to a different angle of incline between each of the at least half of the successive nightly sleep periods.

2. The method of claim 1, wherein the predetermined unit of is a weekly unit of time.

3. The method of claim 1, wherein the predetermined unit of time is a monthly unit of time.

4. The method of claim 1, wherein the predetermined unit of time is a yearly unit of time.

* * * * *